US007044725B2

(12) United States Patent
Rantala

(10) Patent No.: US 7,044,725 B2
(45) **Date of Patent: *May 16, 2006**

(54) LEVER-MECHANISM MOTOR OR PUMP

(76) Inventor: Veikko Kalevi Rantala, Suvipellontie 20, FIN-049290, Vastila (FI)

( * ) Notice: Subject to any disclaimer, the term of this patent is extended or adjusted under 35 U.S.C. 154(b) by 0 days.

This patent is subject to a terminal disclaimer.

(21) Appl. No.: 10/988,159

(22) Filed: Nov. 12, 2004

(65) Prior Publication Data

US 2005/0087156 A1 Apr. 28, 2005

Related U.S. Application Data

(63) Continuation of application No. 10/391,055, filed on Mar. 17, 2003, which is a continuation of application No. 09/869,740, filed as application No. PCT/FI00/00034 on Jan. 18, 2000, now abandoned.

(30) Foreign Application Priority Data

Jan. 18, 1999 (FI) ..... 990083

(51) Int. Cl.
*F03C 2/00* (2006.01)

(52) U.S. Cl. ..... 418/248; 418/249; 418/12; 418/83

(58) Field of Classification Search ..... 418/248, 418/249, 250, 12, 63, 83
See application file for complete search history.

(56) References Cited

U.S. PATENT DOCUMENTS

| | | | | |
|---|---|---|---|---|
| 715,933 | A * | 12/1902 | Allen | 418/249 |
| 778,091 | A * | 12/1904 | Wiest | 418/249 |
| 3,216,406 | A * | 11/1965 | Welm | 418/248 |
| 4,214,557 | A | 7/1980 | Beach | |
| 4,423,710 | A | 1/1984 | Williams | |
| 4,487,167 | A | 12/1984 | Williams | |

* cited by examiner

*Primary Examiner*—Theresa Trieu
(74) *Attorney, Agent, or Firm*—Skinner and Associates

(57) ABSTRACT

A machine, such as an engine, which includes a cylinder (1), an essentially cylindrical piston (5) set on bearings and equipped with an eccentrically-set shaft (11), an inlet port or valve (8), an outlet port or valve (9), and a lever device (7), which is attached by bearings to a shaft (6) and which is intended to be in essentially tight contact with the piston (5). The cylinder (1) forms an essentially cylindrical chamber for the rotary piston (5) and a partially cylindrical chamber for the lever device (7) that moves backwards and forwards. The piston (5) is equipped, in the interior of the working chamber, with sliding-ring-type bearings (13, 14).

15 Claims, 7 Drawing Sheets

LEVER-MECHANISM MOTOR OR PUMP

CROSS-REFERENCE TO RELATED APPLICATIONS, IF ANY

This is a continuation of application Ser. No. 10/391,055, filed Mar. 17, 2003, which is a continuation of application Ser. No. 09/869,740, filed Jul. 3, 2001, now abandoned, which claims the foreign priority benefits under Title 35, U.S.C. §119(a)–(d) or §365(b) of any foreign application(s) for patent or inventor's certificate, or §365(a) of any PCT International application which designated at least one country other than the United States of America, of PCT Application No.: PCT/F100/00034, filed Jan. 18, 2000, and Finland Application No.: 990083, filed Jan. 18, 1999, which are hereby incorporated by reference.

STATEMENT REGARDING FEDERALLY SPONSORED RESEARCH OR DEVELOPMENT

Not applicable.

REFERENCE TO A MICROFICHE APPENDIX, IF ANY

Not applicable.

FIELD OF INVENTION

The present invention relates to a lever-mechanism engine, and specifically to a lever-mechanism engine or pump, which, in the following, will be generally referred to as a lever-piston engine. The engine is of a type that has two separately operating pistons. The operation of the engine is based on the thermal expansion or contraction of a medium. The operation may be based on a closed and/or open thermodynamic principle, and in general on exploiting the pressure of a medium.

SUMMARY OF THE INVENTION

Engines coming within the scope of the invention are, in terms of their operating principle, usually engines and devices based on the expansion of an enclose medium, such as steam turbines and steam engines, as well as hot-air engines.

Engines of this type convert thermal energy into mechanical energy by forcing a gaseous medium to move through a closed thermodynamic cycle. The thermal energy is produced by heating the medium from outside in a boiler or similar heating device.

Steam turbines and engines have advantages, such as the fact that many suitable fuels are available for use in them and that a relatively high efficiency can be obtained, if the heat from condensation can also be exploited. However, their drawbacks include the large size of the total device, the need for continual monitoring of its operation, and the need for servicing, due to the accumulation of soot and boiler scale.

One advantage in hot-air engines over, for example, conventional internal combustion engines, is that the exhaust gases are relatively clean, having a low carbon dioxide content and practically no unburned hydrocarbons.

Open-thermodynamic-principle engines in use are of the most conventional type, which generally uses a crankshaft to convert a piston's back and forwards movement to rotary movement, which can be easily exploited as mechanical work. However, the torque of the crankshaft varies continually and is maximal for only a short period in the working stage, which itself is only a small part of the total operation of the engine.

In older combustion engines of this type, the so-called stroke, i.e. the length of the movement of the piston, is greater than the diameter of the piston. In newer engines, however, the stroke is nearly the same size as the diameter of the piston, but, in these too, the ratio of the effective (piston) surface area to the ineffective (internal surface of the cylinder and its head) surface area is relatively small, thus contributing to the engine's poor efficiency.

A so-called rotary-piston engine, in which the piston no longer moves backwards and forwards, but produces work by rotating, is also known. The best-known engine of this type is the Wankel engine, which is also famous for the slow progress of its development, due in particular to great difficulties in sealing the piston.

The greatest advantages of the rotary-piston engine, compared to a conventional engine equipped with a piston with linear movement, are the evenness of its operation, the evenness of its torque, the small number of parts subject to wear, its light weight, and its basic simplicity.

Naturally, the rotary-piston engine has some drawbacks, especially when used as an internal combustion engine, such as the sealing problem already referred to, the difficulty of arranging simple cooling for the engine, and fairly low efficiency.

In summary, it can be said that energy devices presently used suffer from the following general drawbacks: the use of only a few sources of energy, which are also non-renewable, the large amount of pollution created by the combustion of the fuel, low efficiency, the slowness of regulating the power output, the large size and complexity of the apparatus, and, as a further highly significant aspect, an inability to exploit low-temperature energy in any way.

The present invention is intended to help to improve the utilization of energy and create an machine, engine, or pump operating on the lever-mechanism principle, which is efficient, because it can exploit the entire pressure difference of the medium, while also containing few moving parts, the paths of travel of which are short and the sealing of which can be easily arranged, and has friction that is mainly the rolling friction in the bearing, the whole device having a construction that is multi-purpose, simple, and light. An engine according to the invention has a wide torque range, while the effective surface area of the pistons is great in relation to the volume of the cylinder.

In addition, the same apparatus can be operated using many different sources of energy. Best of all, an engine according to the invention can also be used especially to exploit renewable sources of energy and 'residual' energy that other devices are unable to exploit.

An apparatus according to the invention can also be used to exploit relatively low-temperature energy. The engine also does not need external cooling, when using a source of high-temperature energy or 'residual' energy from some other device, being instead able to function as a radiator and/or cooler itself, while simultaneously increasing the overall efficiency.

When a machine according to the invention is used as an engine, it creates a small pollution load and can even be used to reduce the polluting effect of the exhaust gases of some other engine, as will be described later. These characteristics also extend the use of the engine to certain special applications.

An apparatus according to the invention can be used to exploit the pressure of a medium with a good efficiency, as the apparatus can be constructed in a form corresponding to specific requirements. For example, when exploiting the power of rapids or tidal power, the apparatus can be of the same size as the dam structures and can be built for large and/or small amounts of water and pressures.

The aforementioned and other advantages and benefits of a machine according to the invention are achieved by means of a solution, the characteristic features of which are stated in the accompanying Claims.

BRIEF DESCRIPTION OF THE DRAWINGS

The invention is now explained in greater detail, with reference to the accompanying drawings, in which.

DETAILED DESCRIPTION OF THE PRESENTLY PREFFERED EMBODIMENTS

In the following, general reference will only be made to an engine, as it is simpler and because a pump uses the technical components as such of the solutions according to the invention. Thus, reference to an engine is intended to apply to all embodiments of the invention. On the other hand, in the following, general reference will be made to the invention, using even highly detailed and restricted definitions of its various components. However, this is only done for the sake of clarity, the terms used representing only one example of mutually equivalent alternative forms of the component in question.

Figure 3:
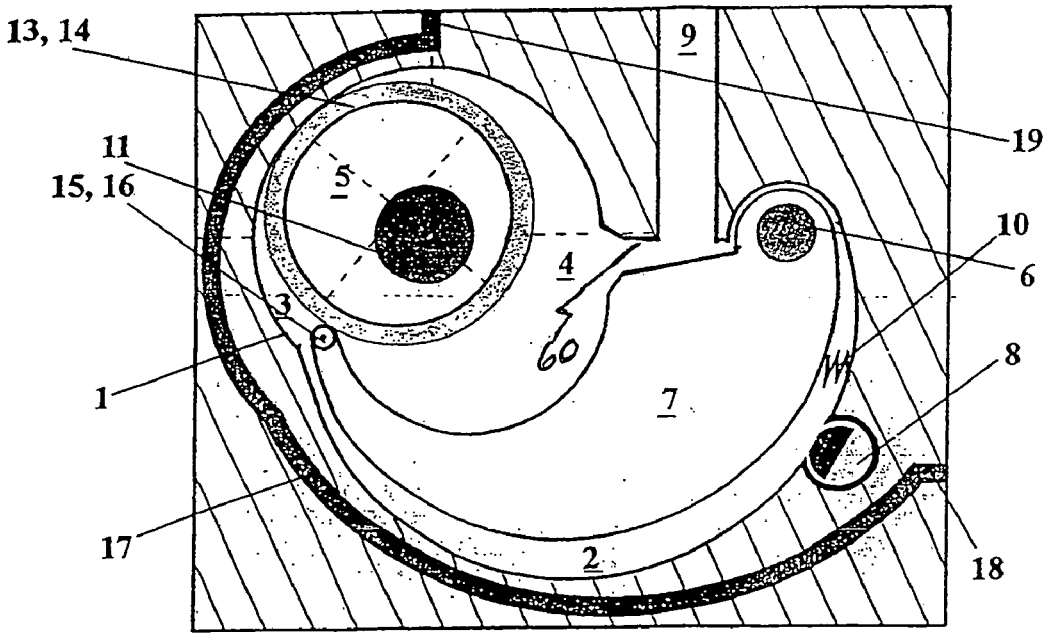

First of all, a general description is given of an engine according to the invention, which will follow, for example, FIG. 3 and, in exceptional cases, other figures too.

The simplest embodiment of an engine according to the invention inclues, to use conventional engine terminology, an engine block, which is shown generally in the figures as a shaded area, without a reference number. The block can be made from any material generally used for this purpose, though, in the typical uses of an engine according to the invention, the same standard of durability is not required as, for example, in a conventional internal combustion engine. Thus the material used can be selected from a wider range than that traditionally available, while, at least in most applications, relatively light materials and those with poor thermal conductivity can also be used.

The engine block generally has a flat shape, when viewed along the plane of the paper in FIGS. 1–8. It can be assembled from two or more parts lying on top of each other, which are suitably secured to each other, for example, in the same way as the cylinder head of an internal combustion engine is secured to its cylinder block.

However, as stated, there may be several parts, if this will achieve the desired characteristics.

The other components in a solution according to the invention naturally comprise gaskets, the piping connected to the various inlet and outlet channels, the valves, heaters, etc. for the medium, and devices used to provide power take-off from the engine.

In order to illustrate the operation, these components and technical solutions do not appear separately in the figures and explanations, but the various adaptations and additional components and devices for each requirement will be fully obvious to one versed in the art, on the basis of the disclosure and figures.

Thus, in general, an engine according to the invention inclues an engine block (the shaded area), in which, in this case, two cylinders are bored to form working lever and piston chambers 2 and 3, respectively. Flat step portion 20 is disposed between the lever 2 and piston 3 chambers. Shafts 6 and 11 run through these working chambers 2 and 3, at right angles to the surface of the paper in the figures, and are mounted in bearings, with, for example, the ends of the shafts above the paper being set in bearings in the 'head' of the engine, while the shaft ends below the plane of the paper enter the 'base' of the engine and are mounted in bearings in it.

The power take-off is from shaft 11, which, for example, has keyways and an eccentric rotary piston 5 attached to it with a key. Rotary piston 5 has rolling bearings, and rings or collars 13 and 14, which reduce friction and seal rotary piston 5 in working chamber 3.

References in the following to rotary piston 5 generally apply, for the sake of clarity, to the combination formed by rotary piston 5 and rolling bearings 13 and 14. If it is necessary, to understand some operation or construction, reference will also be made, in connection with rotary piston 5, for instance, to rolling bearings 13 and 14 and hinge component 15.

The lever device, which, in the following, is referred to as lever piston 7, is attached by bearings to shaft 6 and is, for example, hinged to hinge component 15 in rotary piston 5 between rolling bearings 13 and 14, so that they are in tight contact with each other, without causing significant friction when they move. An alternative possibility is also to equip the lever piston with a spring 10 and, additionally, with bearings 16 to reduce friction and provide a seal.

The internal construction of the engine is as follows. Shafts 6 and 11, as stated above, run through the bores of working chambers 2 and 3 of cylinder 1.

Rotary piston 5 is attached eccentrically to shaft 11 and lever piston 7 is attached to shaft 6, for example, as stated above, but nevertheless eccentrically close to its outer edge, as can be clearly seen in the figure. In this case, the large amount of eccentricity is an advantage, because it is precisely the means by which power is created in the lever-mechanism engine.

Lever piston 7 and its corresponding bore, which forms working chamber 2, is clearly larger than rotary piston 5. Rotary piston 5 is essentially a cylindrical piece, with a circular cross-section. The outer side of lever piston 7 is particularly shaped as the arc of a circle. Near its end farthest from shaft 6 there is a bore, which is nearly the size of half of rotary piston 5, as shown in the figure. Rotary piston 5 indeed rotates during each cycle into the bore in lever piston 7, when exhaust chamber 4 vanishes almost entirely and empties into open outlet channel 9, which, in the figures, is open to a chamber with a lower pressure.

Outlet channel 9 can be led, for instance, to the inlet valve 8 of a second lever mechanism engine, which may also be only an inlet channel without a valve device, so that there is no limit to the number of engines that can be connected in series in solutions according to the invention. The motor units can be connected to each other, with the rotary pistons 5 of each unit also being connected to each other, by shafts 11, either in the same position or at a desired angle to each other.

The volumes of the combined engine units can be varied as desired, to be appropriate to the mediums used, or to suit other requirements and objectives. The engine unit volumes can be varied, for example, by altering the diameter or length of the cylinder or altering the relative sizes of lever piston 7 and rotary piston 5.

In FIGS. 1–8, inlet valve 8 is shown as a diagrammatic solution, because there are many inlet valve systems and devices that suit the engine. FIG. 9 shows one such simple solution, in which a cylindrical perforated plate is attached to shaft 11, and closes and opens, as desired, the engine's inlet channel, which may be at inlet valve 8.

It is also possible for the engine to have a channel or chamber 17, between the outer jacket and cylinder 1, in the engine block (the shaded area). The shape, size, etc. of channel 17 can vary to suit each requirement, and it may have inlet ports 18 and outlet ports 19 or valves and other devices required in specific cases. The figures and explanations present one solution according the example.

The following is a detailed description of the operation of an engine according to the invention, detailing a full 360-degree cycle of the engine, stage by stage, in the order of FIGS. 1–8.

FIG. 1

Starting Work Stroke and Exhaust Stroke

The rotary piston 5 of cylinder 1 is in a position, in which lever piston 7 has passed its furthest position from shaft 11 and has already moved closer to it, due to the effect of the pressure of the medium in working chamber 2, because inlet valve 8 is open. The feed and expansion of the medium continue and lever piston 7 pushes rotary piston 5 clockwise, while simultaneously the effect of the medium has also commenced in working chamber 3, where the pressure acts on rotary piston 5, turning it too clockwise.

Simultaneously, rotary piston 5 presses the medium from the previous working stage in exhaust chamber 4, through outlet channel 9, to a space with an essentially lower pressure.

FIG. 2

Work and Exhaust Stroke

The medium continues to expand in working chambers 2 and 3, lever piston 7 pushes rotary piston 5, which is also affected by the expansion of the medium and, as the pressure surface area of rotary piston 5 increases, shaft 11 rotates clockwise, even though medium inlet valve 8 is closed. Rotary piston 5 continues to press the medium of the previous working stage in exhaust chamber 4, through outlet channel 9, to a space with an essentially lower pressure.

Figure 5:
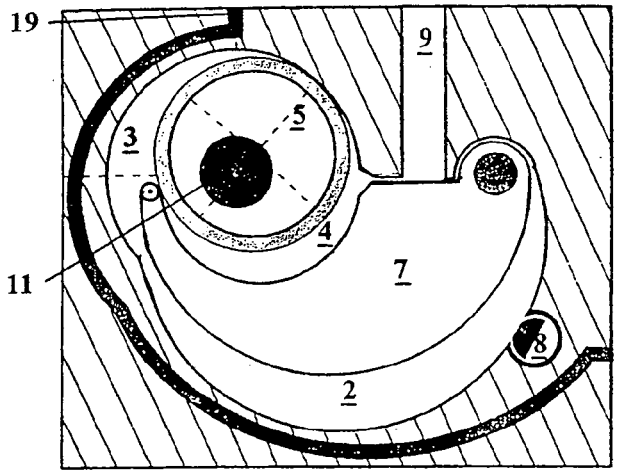

Depending on the power required and the desired efficiency, the medium can continue to be fed through inlet valve 8 to working chamber 2, right up to the final stage of the work stroke (FIG. 5).

FIG. 3

Work and Exhaust Stroke

The medium continues to expand in working chambers 2 and 3, lever piston 7 pushes rotary piston 5, which is also affected by the expansion of the medium, and, because the pressure surface area of rotary piston 5 increases, shaft 11 rotates clockwise, even though medium inlet valve 8 is closed. Rotary piston 5 still continues to press the medium from the previous work stage in exhaust chamber 4, through outlet channel 9, into a space with an essentially lower pressure.

Rotary piston 5 has rolling bearings 13 and 14, which reduce friction and seal rotary piston 5 in working chamber 3. Similarly, lever piston 7 has bearings 16 and is spring 10 or equipped with a hinge component 15. This solution will be explained in greater detail (in FIG. 9).

The efficiency of the lever-mechanism engine can be increased, by using channel 17 to direct possible gases or liquids, which are hotter than the medium and have been created by heating the medium or other combustion, through inlet port 18 and outlet port 19, and between the engine's thermally insulated outer jacket.

FIG. 4

Work and Exhaust Stroke

The medium continues to expand in working chambers 2 and 3, lever piston 7 pushes rotary piston 5, which is also affected by the expansion of the medium, and, because the pressure surface area of rotary piston 5 increases, shaft 11 rotates clockwise, even though medium inlet valve 8 is closed. Rotary piston 5 still continues to press the medium of the previous work stage in exhaust chamber 4, through outlet channel 9, to a space with an essentially lower pressure.

FIG. 5

Work and Exhaust Stroke

The medium continues to expand in working chambers 2 and 3, lever piston 7 pushes rotary piston 5, which is also affected by the expanding medium, and, because the pressure surface area of rotary piston 5 increases, shaft 11 rotates clockwise, though medium inlet valve 8 is closed. Rotary piston 5 still continues to press the medium from the previous work stage in exhaust chamber 4, through outlet channel 9, into a space with an essentially lower pressure.

Depending on the required power and the desired efficiency, the medium can continue to be fed through inlet valve 8 to working chamber 2, right up to the end of this work stroke (FIG. 5). Simultaneously, the combustion gases no longer increase the efficiency, as rotary piston 5 has passed outlet port 19.

If there are two lever-mechanism engines on the same shaft 11, with their rotary pistons 5 at an angle of 180 degrees to each other, the other engine will be starting (FIG. 1) the work and exhaust stroke.

FIG. 6

Ending Work and Exhaust Stroke

The lever piston 7 and rotary piston 5 of cylinder 1 are in working chambers 2 and 3, surrounded by expanded medium while the medium of the previous work stage has been reduced in exhaust chamber 4 through outlet channel 9 to such an extent that rotary piston 5 has rotated in the bore in lever piston 7 and filled the bore entirely.

Figure 2:
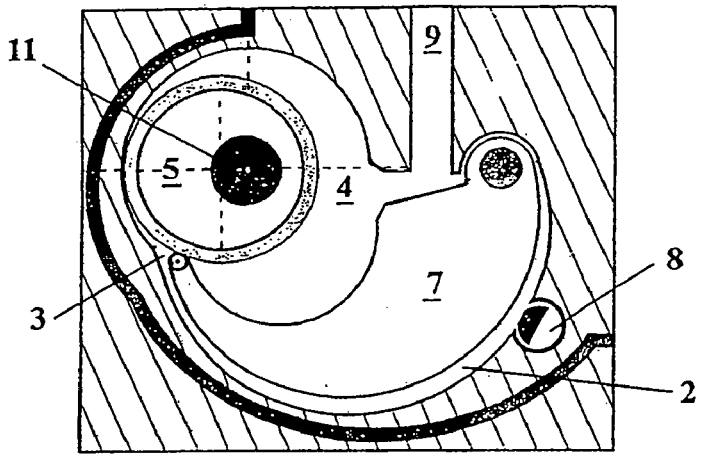

If there are two lever-mechanism engines on the same shaft 11, with their rotary pistons 5 at a 180-degree angle to each other, the other engine will be in the work and exhaust stroke (FIG. 2).

FIG. 7

Starting Exhaust Stroke

Rotary piston 5 has-begun to rotate out of the bore of lever piston 7 while, inside cylinder 1, exhaust chamber 4 is fully open through outlet channel 9.

If there are two lever-mechanism engines on the same shaft 11, with their rotary pistons 5 at a 180-degree angle to each other, the other engine unit will be in the work and exhaust stroke (FIG. 3).

FIG. 8

Exhaust Stroke

Rotary piston 5 continues to rotate out of the bore in lever piston 7 while exhaust chamber 4 is fully open through outlet channel 9.

Figure 4:
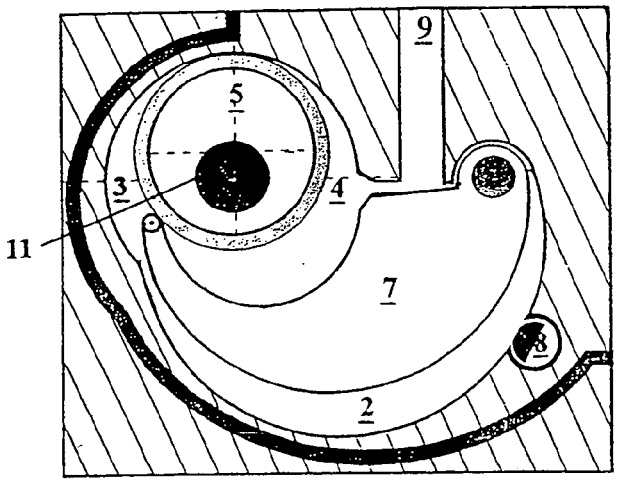

If there are two lever-mechanism units on the same shaft 11, with their rotary pistons 5 at a 180-degree angle to each other, the other engine unit will be in the work and exhaust stroke (FIG. 4).

The above explanation, referring to FIGS. 1–8, depicts an operating cycle taking place according to the so-called closed thermodynamic principle.

In such a case, one possible example of an operating power solution is for the hot exhaust gases of a conventional internal combustion engine to be led through channel 17 to heat the desired area of cylinder 1 of the engine. The medium creating expansion is usually water/steam, which can also be cooled or condensed, if required, in a series of several engine units according to the invention.

Any method or manner at all, that creates a medium of a suitable temperature for each purpose, can be used to create the hot gas or medium.

An engine according to the invention can be used, for example, so that the outside of the walls of cylinder 1 are heated by solar heat, for instance, by using mirrors and/or lenses to direct solar heat as a suitably concentrated beam of light to the desired point on the side of the engine, or by using a medium through channel 17.

Alternatively, an engine according to the invention could operate, for instance, by heating it with a flame on the outside of cylinder 1. In this case, the hot gases created from the combustion of the flame can also be recovered, by sucking them into the engine through inlet valve 8 and, when inlet valve 8 closes, passing the medium, through a separate valve, into working chamber 2 to expand.

FIG. 9

Engine Units Operating in Parallel, the First of Which is in the Starting Work and Exhaust Stroke and the Other is in the Work and Exhaust Stroke FIG. 9 shows the engine blocks 20 and 40, lever pistons 7 and 27, rotary pistons 5 and 25, rolling bearings 13,14,33, and 34 and hinge components 15 and 35 between them, in a cross-section through the centre of shaft 11, but with shaft 11 not sectioned. The cross-sections are vertical sections of FIGS. 1 and 5.

In addition, the connection of lever piston 7 to hinge component 15 in the first engine unit is shown in partial cross-section. The explanation of the operation also uses the reference numbers from FIGS. 1,3, and 5.

The figure shows two lever-mechanism engine units on the same shaft 11, with their rotary pistons 5 and 25 at 180 degrees to each other. The first engine unit is in (FIG. 1) the starting work and exhaust stroke and the other is in (FIG. 5) the work and exhaust stroke.

In the example of a solution in FIG. 9, the medium enters the engine units through a common channel 41, from which valve plate 12 directs the medium to each engine unit, as shown in the figure with an arrow for clarity.

Channels 17 are linked in each engine unit, so that the same medium circulates in them from inlet port 18 to outlet port 19, but, as stated elsewhere, there are several alternative solutions.

Starting Work and Exhaust Stroke of the First Engine Unit

Rotary piston 5 of cylinder 1 is in a position, in which lever piston 7 has passed its farthest position from shaft 11 and has already moved closer to it, due to the effect of the medium in working chamber 2, because the port in valve plate 12, i.e. inlet valve 8, is open to channel 41, allowing the feed of the pressurized medium to continue.

The hotter medium in channel 17, such as the combustion gases from the heater of the medium in working chambers 2 and 3, heats cylinder 1 and lever piston 7 pushes rotary piston 5 (upwards in the figure) clockwise. Simultaneously, the hot medium in channel 17 already starts to reheat the medium that has cooled due to the increased volume of working chamber 2, increasing its pressure.

A corresponding effect of the medium in channel 17 has also begun in working chamber 3, in which the pressure also acts on rotary piston 5, turning it too clockwise.

When the volume of working chambers 2 and 3 increases, the medium in them simultaneously cools, in turn cooling the medium, i.e. combustion gases, in channel 17.

Simultaneously, rotary piston 5 pushes the previous work stroke's medium in exhaust chamber 4 through outlet channel 9 (outside the section line) into a space with an essentially lower pressure.

Work and Exhaust Stroke of the Second Engine Unit

The medium continues to expand in working chambers 22 and 23 of cylinder 21, lever piston 27 pushes rotary piston 25, which is also affected by the expanding medium and, as the pressure surface-area of rotary piston 25 increases, shaft 11 rotates clockwise, though the port, i.e. inlet valve 28, in valve plate 12 is closed.

Rotary piston 25 continues to push the previous work stroke's medium in exhaust chamber 24 through outlet channel 29 (exhaust chamber 24 and outlet channel 29 are outside the section line) into a space with an essentially lower pressure.

Depending on the power required and the desired efficiency, the medium can continue to be fed into working chamber 22 through inlet valve 28, until the final stage of its current (FIG. 5) work stroke. In the final stage of the work stroke, the heating effect of the combustion gases of channel 17 has diminished inside cylinder 21, as rotary piston 25 has passed outlet port 19.

The engine units can differ from those in FIG. 9 by having different sizes with the second engine unit, for example, being longer parallel to shaft 11, to meet different needs, though the various components' diameters remain the same.

The engine units can also differ from FIG. 9, for instance, by being connected in series, with the requisite number of openings being made in valve plate 12 and channels being made to lead the medium to the right place, with the right timing.

The medium is then led to channel 41, through valve plate 12 and channel 8, first to cylinder 1 and, after passing through all the stages (FIGS. 1–8), it moves through outlet channel 9, through valve plate 12 and channel 28, to cylinder 21, where, after passing through all the stages (FIGS. 1–8), it cools and moves, through outlet channel 29, to a space with a lower pressure.

The medium travelling in channel 17, for example, the heater's combustion gases, first heat cylinder 1 and then cylinder 21, when they cool and are exhausted through outlet channel 19.

FIGS. 10–17 show, as examples, diagrams of a unit, formed by a series of three machines/engines according to the invention, at 45-degree intervals in a complete 360-degree revolution. The explanations include a reference number in brackets, referring to the current stage of FIGS. 1–8 of each engine unit, FIGS. 1–8 describing the operation of the engine in greater detail, through its various stages.

The engine units connected as a compound series according to the invention comprise a high-pressure unit, a medium-pressure unit, and a low-pressure unit (here listed from left to right).

The high-pressure unit's reference numbers generally correspond to those of FIGS. 1–8. The medium-pressure unit's reference numbers are most the same as those of the second engine unit of FIG. 9. The low-pressure unit has corresponding components and reference numbers 52–69 in the same logical order as in the other engine units.

The engine's head 71, intermediate heads 72 and 73, and base 74 also act as the bearings of shaft 11. These heads 71–74 can also be used to direct the medium to the requisite place at each time, but, for clarity, FIGS. 10–17 use the same inlet and outlet channels as in the previous figures.

For the sake of clarity, arrows and reference numbers are also used to show the paths of the medium and the gases of the heating channels.

FIGS. 10–17 show rotary pistons 5,25, and 55 of the three units connected in series, as an engine according to the invention, on shaft 11 at different angles to each other, though rotary pistons 5,25, and 55 can also be in the same position in relation to each other on shaft 11, when the engine blocks will correspondingly be at different angles to each other.

The volumes of the connected engine units can be varied as desired, to suit the available mediums or other requirements and objectives.

The volumes of the engine units can be varied, for example, by altering the diameter or length of the cylinders, or the relative sizes of the lever pistons and rotary pistons.

The volumes of the engine units can be dimensioned, for example, so that the vaporized medium will change to liquid, after passing through the entire closed thermodynamic cycle from the high-pressure unit, through the medium-pressure unit, to the low-pressure unit.

In the engine solution example according to the invention, if water/steam is used as the medium, the volume of the low-pressure unit must be at least four times greater, and that of the medium-pressure unit two times greater, than that of the high-pressure unit. The engine units' lengths and widths remain the same, but their depth varies, to create suitable differences in volume.

One possible drive power solution is for the hot exhaust gases of a conventional combustion engine to be led first through a heater 42, to heat the medium in pressure chamber 43 and then through channels 17 and 37, to heat the desired areas of the engine blocks.

Heater 42 can also be constructed so that the source of energy can be the most diverse heat-producing operating power solutions, even used alternatively and in parallel in the same device.

FIG. 10

Figure 7:
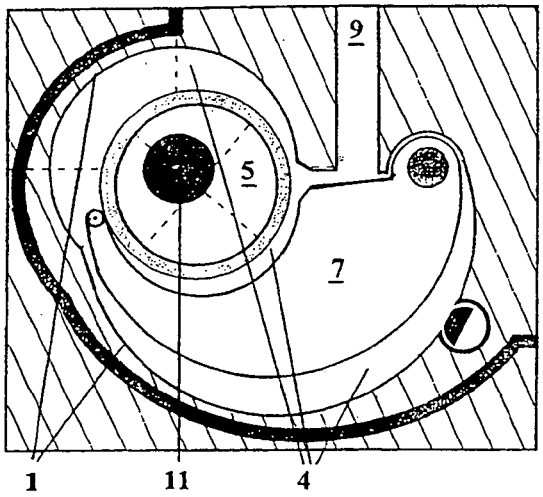

Starting work stroke and exhaust stroke in the high-pressure unit (FIG. 1), work stroke and exhaust stroke in the medium-pressure unit (FIG. 4), and starting exhaust stroke in the low-pressure unit (FIG. 7).

The medium in the pressure chamber 43 of heater 42, which was pumped there in the previous revolution as a liquid, has vaporized. When valve 8 of the high-pressure unit opens, the high-pressure medium is released into working chamber 2 and pistons 7 and 5 rotate shaft 11 clockwise.

In exhaust chamber 4 and in working chambers 22 and 23 of the medium-pressure unit, the pressure of the medium has dropped due to the increase in their volume, even though the combustion gases of the heater travelling through channels 17 and 37 release addition heat to the medium as they cool.

Because exhaust chamber 24 of the medium-pressure unit and chambers 52,53,54, and 59 of the low-pressure unit are open to each other, the heat and pressure of the medium in them decrease, as, in the previous position of shaft 11 (FIG. 17), the combined volume of these chambers reached the maximum of the medium's entire thermodynamic cycle, pistons 27 and 25 rotating shaft 11 clockwise.

FIG. 11

Figure 8:
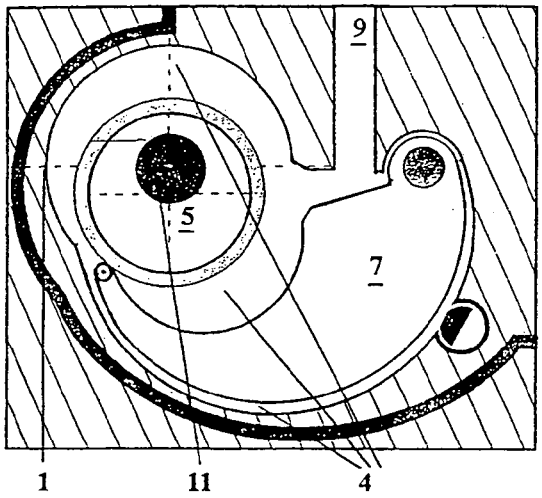
Figure 9:
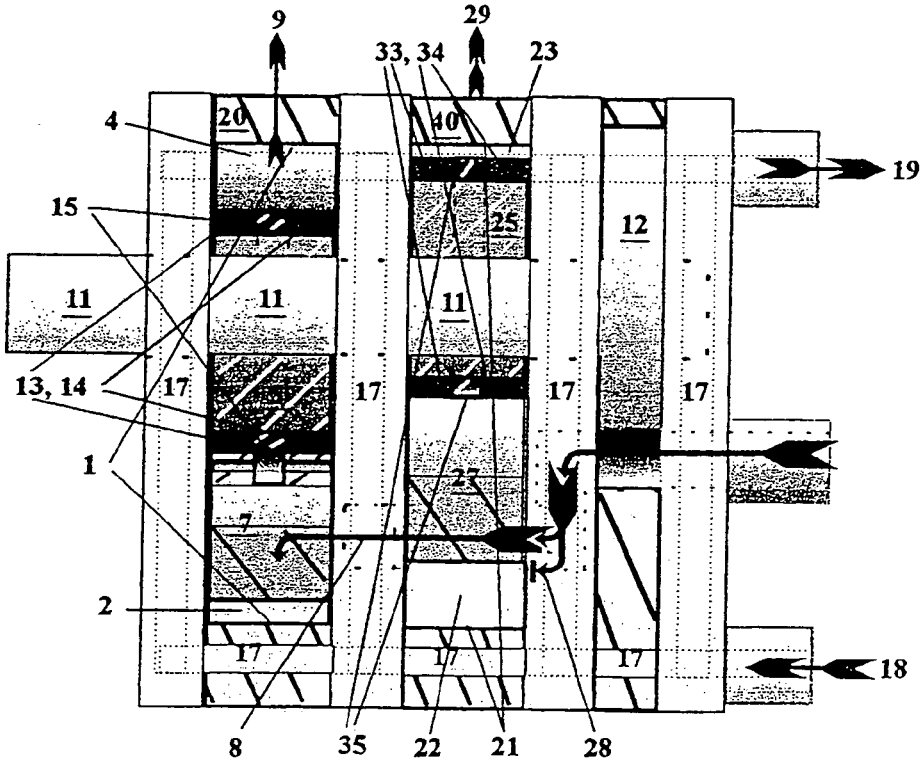
FIG. 9 shows a side cross-section of a machine according to the invention, in one simple embodiment.
Figure 10:
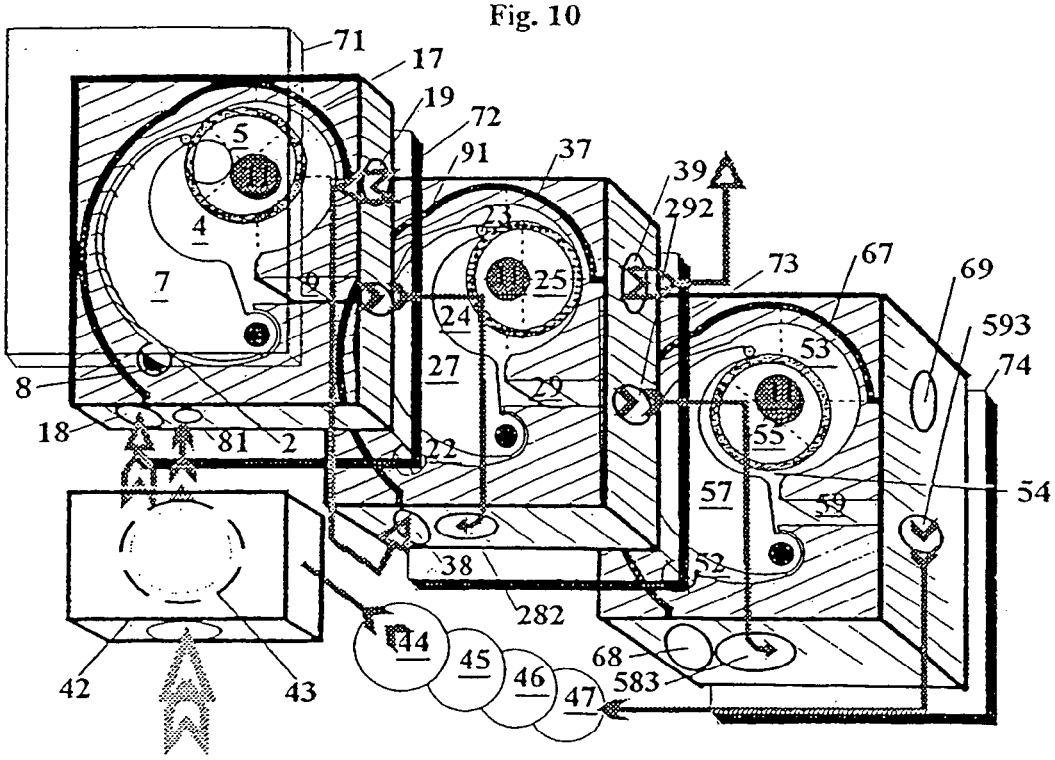
FIGS. 10–17 and the corresponding explanations present diagrams at 45-degree intervals of a full 360-degree cycle of a unit of three machines/engines according to the invention connected in series.
Figure 11:
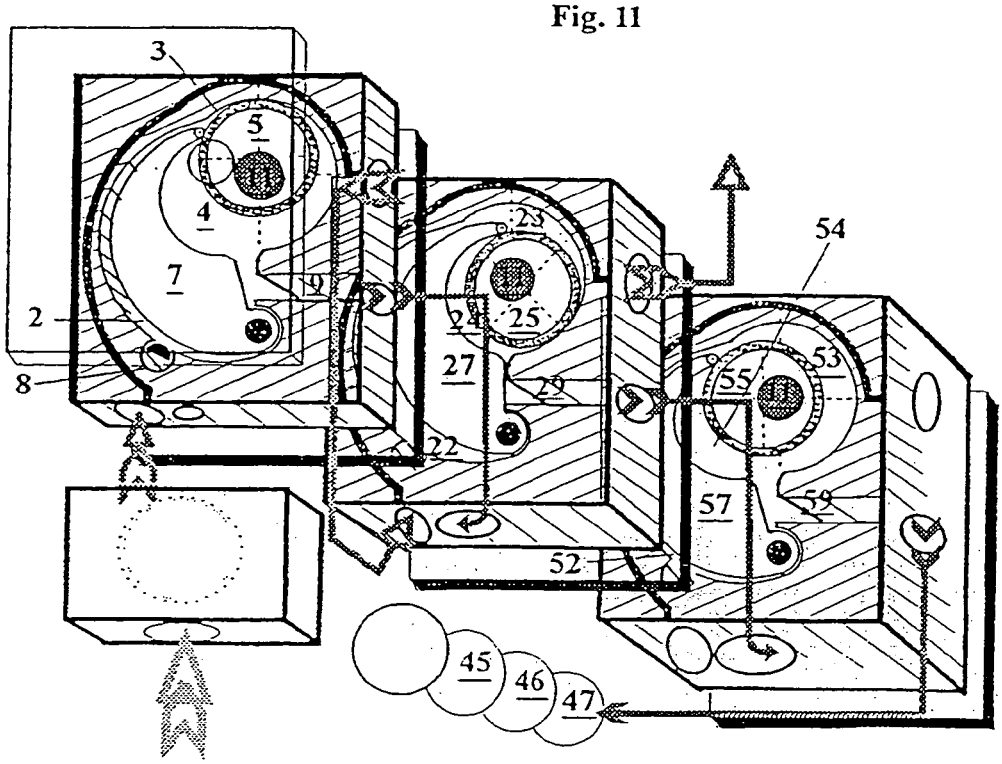
Figure 12:
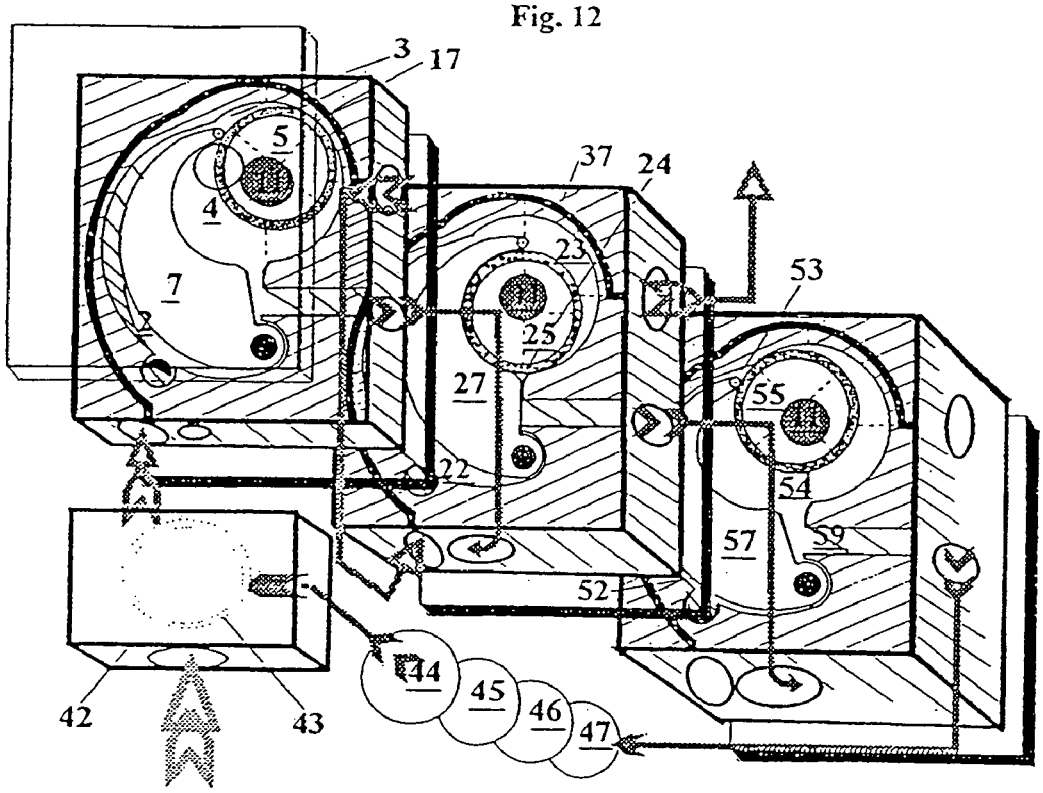
Figure 13:
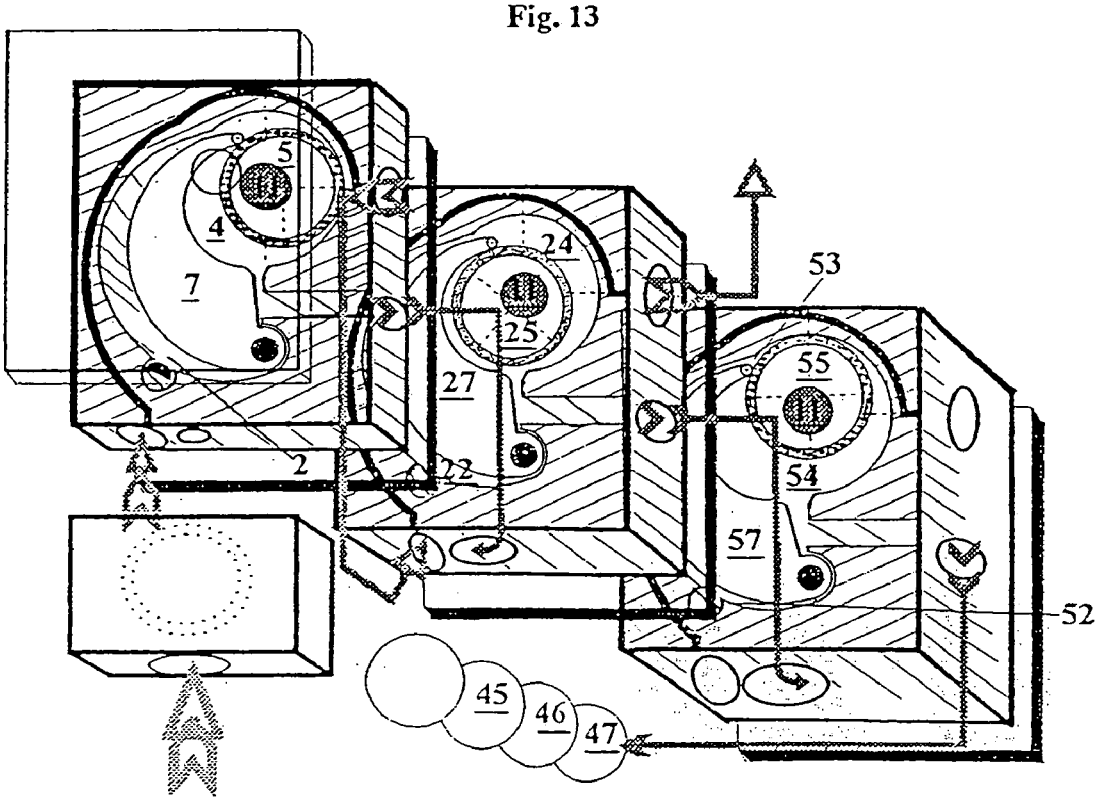
Figure 14:
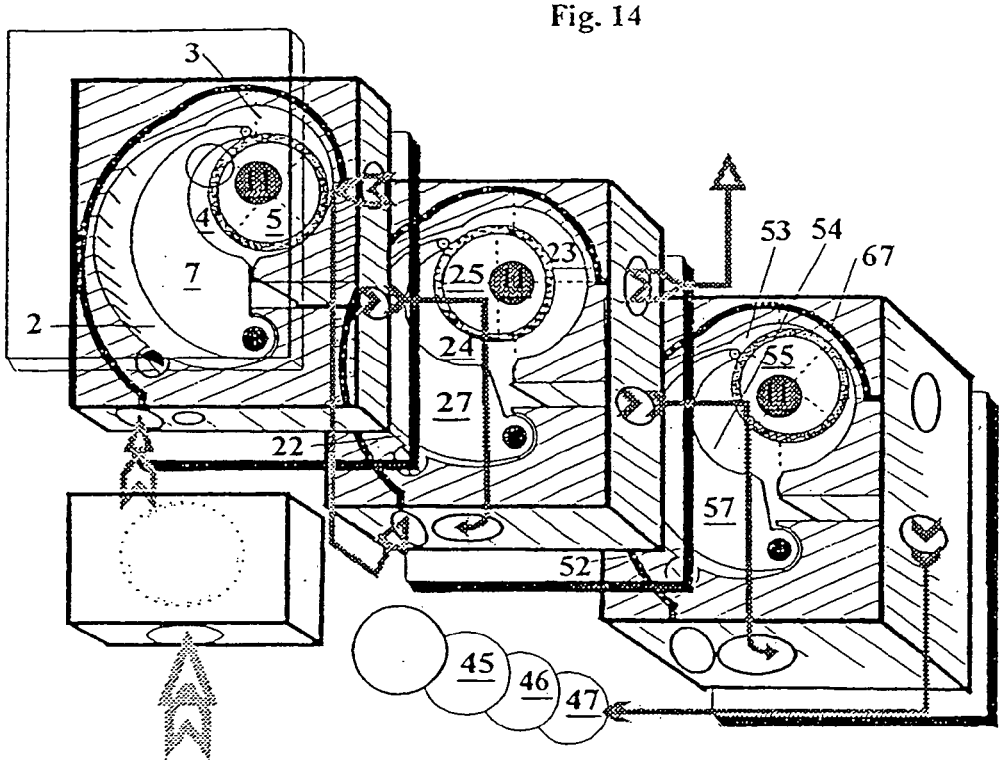
Figure 15:
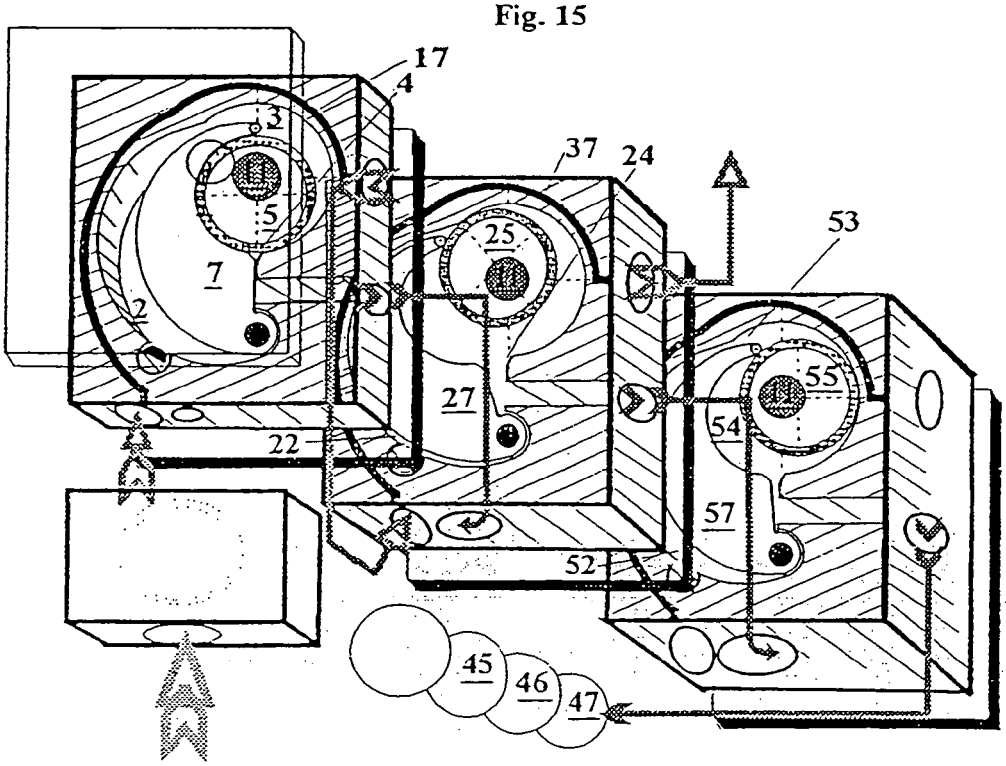
Figure 16:
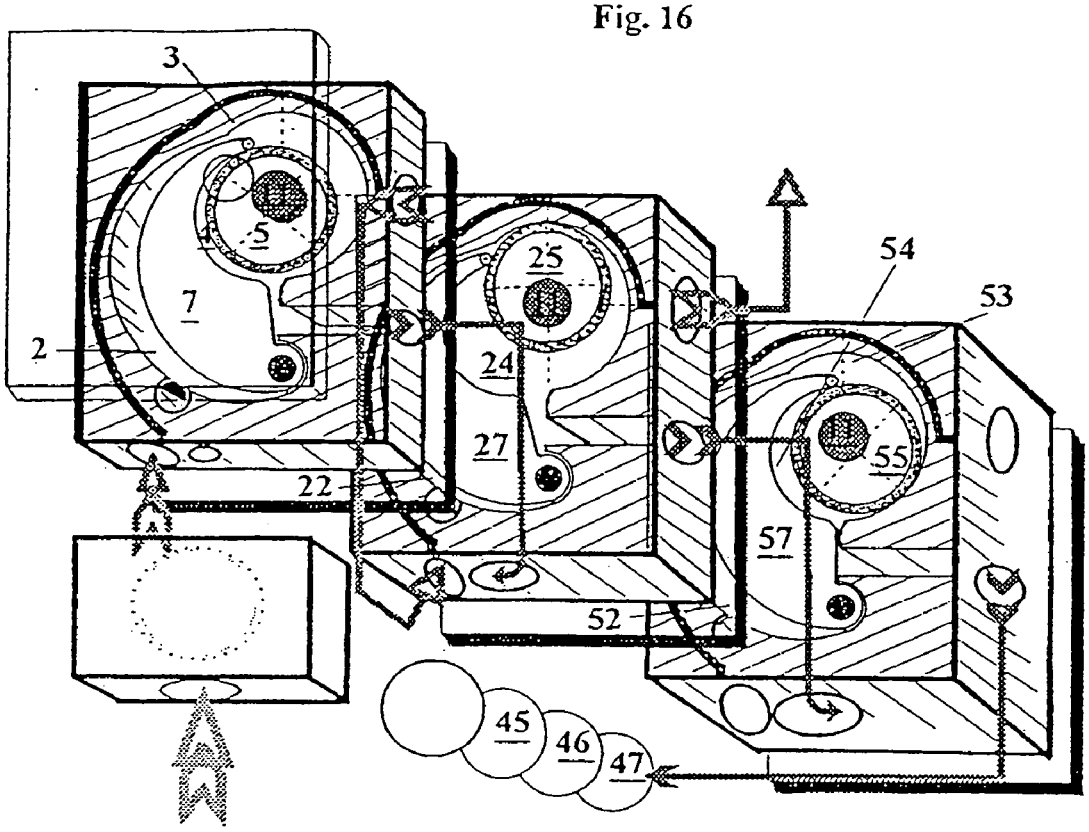
Figure 17:
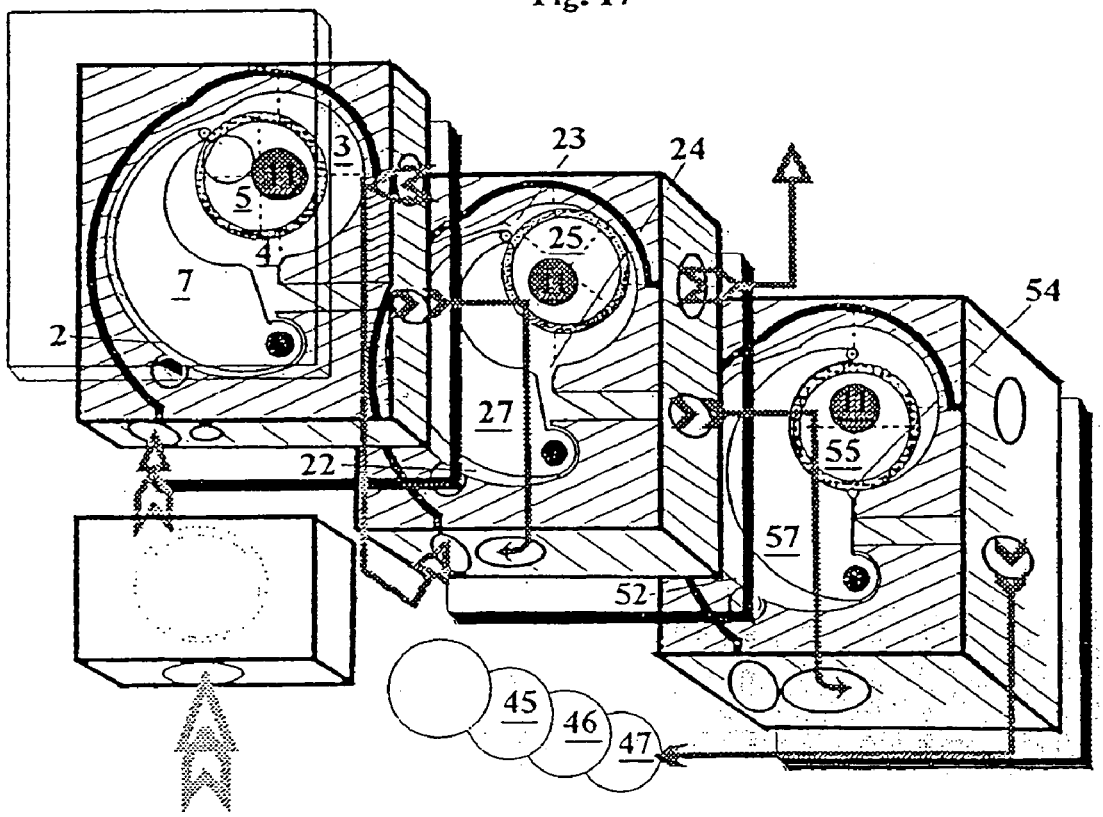

Working and exhaust stroke in the high-pressure unit (FIG. 2), working and exhaust stroke in the medium-pressure unit (FIG. 5), and exhaust stroke in the low-pressure unit (FIG. 8).

Valve 8 of the high-pressure unit has closed while the medium continues to expand in working chambers 2 and 3.

The volume of chambers 4,22, and 23 has continued to increase, the pressure being lower than in chambers 2 and 3, so that pistons 7 and 5 rotate shaft 11 clockwise.

Because exhaust chamber 24 of the medium-pressure unit and chambers 52,53,54, and 59 of the low-pressure unit are still open to each other, the heat and pressure of the medium in them has dropped and condensation continues, while pistons 27 and 25 rotate shaft 11 clockwise.

FIG. 12

Figure 1:
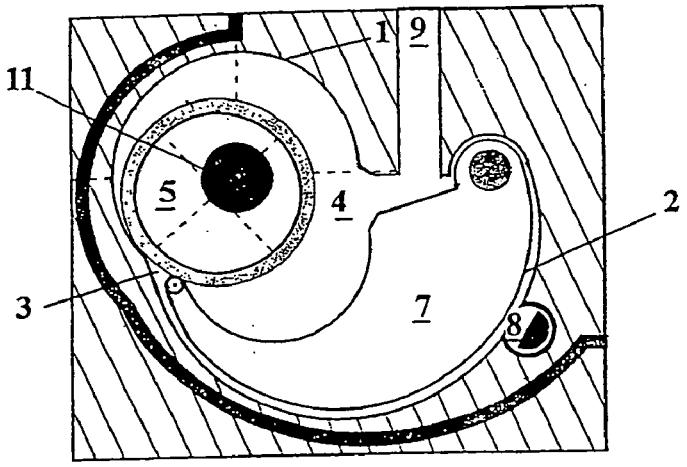
FIGS. 1–8 show diagrams of a full 360-degree cycle of a machine according to the invention, at 45-degree intervals, when it operates as an engine. The explanations corresponding to these figures describe the operation of the engine in greater detail, on the basis of its various stages.

Work and exhaust stroke in the high-pressure unit (FIG. 3), ending work and exhaust stroke in the medium-pressure unit (FIG. 6), and starting work and exhaust stroke in the low-pressure unit (FIG. 1).

The high-pressure medium continues to expand in working chambers 2 and 3.

The volume of the medium-pressure medium has continued to increase in chambers 4,22, and 23, the pressure being lower than in chambers 2 and 3, so that pistons 7 and 5 have rotated shaft 11 clockwise.

Condensation continues in the low-pressure unit, the low-pressure medium always being able (FIGS. 10–17) to discharge through valve 47, as this always opens under excess pressure, the liquid and pressure in outlet channel 59 being released to reservoir 46, any possible excess pressure continuing to be discharged through pump/valve 45.

The new thermodynamic cycle of the medium is started by using pump 44 to spray medium from reservoir 46 into chamber 43.

FIG. 13

Work and exhaust stroke in the high-pressure unit (FIG. 4), starting exhaust stroke in the medium-pressure unit (FIG. 7), and work and exhaust stroke in the low-pressure unit (FIG. 2).

The high-pressure medium continues to expand in working chambers 2 and 3.

The volume of the medium-pressure medium has continued to increase in chambers 4,22, and 23, the pressure being lower than in chambers 2 and 3, so that pistons 7 and 5 have rotated shaft 11 clockwise.

Piston 25 of the medium-pressure unit begins to rotate out of the bore in lever piston 27, the medium pressure acting on pistons 57 and 55 in working chambers 52 and 53 of the low-pressure unit, which rotate shaft 11 clockwise. As pistons 27 and 25 of the medium-pressure unit do not prevent shaft 11 from rotating, the clockwise movement continues.

The medium continues to condense in exhaust chamber 54, any excess pressure in it discharging through valve 47.

FIG. 14

Work and Exhaust Stroke in the High-Pressure Unit (FIG. 5), Exhaust Stroke in the Medium-Pressure Unit (FIG. 8), and Work and Exhaust Stroke in the Low-Pressure Unit (FIG. 3)

The high-pressure medium continues to expand in working chambers 2 and 3.

The volume of the medium-pressure medium has continued to increase in chambers 4,22, and 23. As the pressure is lower than in chambers 2 and 3, pistons 7 and 5 have rotated shaft 11 clockwise.

Piston 25 of the medium-pressure unit continues to rotate out of the bore in lever piston 27, the medium pressure acting on pistons 57 and 55 in working chambers 52 and 53 of the low-pressure unit, which rotate shaft 11 clockwise.

The medium continues to condense in exhaust chamber 54, any excess pressure in it discharging through valve 47.

The condensing of the medium can also be increased by cooling the low-pressure unit through channel 69, which may differ from that shown in the figure.

FIG. 15

Ending work and exhaust stroke in the high-pressure unit (FIG. 6), starting work and exhaust stroke in the medium-pressure unit (FIG. 1), and work and exhaust stroke in the low-pressure unit (FIG. 4).

The expansion of the high-pressure medium continues in working chambers 2 and 3.

The volume of the medium-pressure medium continues to increase in chambers 4, 22, and 23, the pressure being lower than in chambers 2 and 3, so that pistons 7 and 5 have rotated shaft 11 clockwise.

Piston 25 of the medium-pressure unit has rotated out of the bore in lever piston 27, simultaneously closing the direct connection of the medium to the low-pressure unit.

Exhaust chamber 4 has shrunk to its smallest size, while the pressure of the medium in working chambers 22 and 23 has dropped, but, as the heater combustion gases travelling through channel 37 release more heat to the cooling medium, the pressure in the medium-pressure unit increases to exceed that in the low-pressure unit.

The medium pressure continues to act on pistons 57 and 55 in working chambers 52 and 53 of the low-pressure unit, which rotate shaft 11 clockwise.

The medium continues to condense in exhaust chamber 54, any excess pressure in it discharging through valve 47.

FIG. 16

Starting exhaust stroke in the high-pressure unit (FIG. 7), work and exhaust stroke in the medium-pressure unit (FIG. 2), and work and exhaust stroke in the low-pressure unit (FIG. 5).

The high-pressure unit's piston 5 begins to rotate out of the bore in lever piston 7, the high pressure acting on pistons 27 and 25 in working chambers 22 and 23 of the medium-pressure unit, which rotate shaft 11 clockwise.

The medium pressure continues to act on pistons 57 and 55 in working chambers 52 and 53 of the low-pressure unit, which rotate shaft 11 clockwise.

The medium continues to condense in exhaust chamber 54, any excess pressure discharging through valve 47.

FIG. 17

Figure 6:
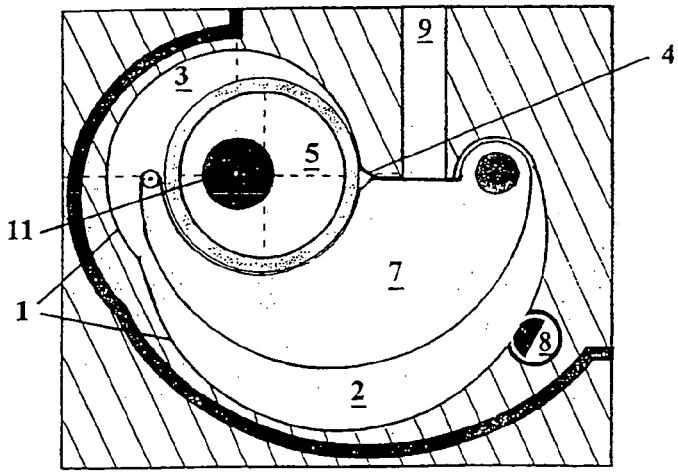

Exhaust stroke in the high-pressure unit (FIG. 8), work and exhaust stroke in the medium-pressure unit (FIG. 3), and ending work and exhaust stroke in the low-pressure unit (FIG. 6).

Piston 5 continues to rotate out of the bore in lever piston 7, the high-pressure continuing to act on pistons 27 and 25 in working chambers 22 and 23 of the medium pressure unit, which rotate shaft 11 clockwise.

Because exhaust chamber 24 of the medium-pressure unit and chambers 52 and 53 of the low-pressure unit are open to each other, the heat and pressure of the medium in them are dropping, and, as the combined volume of these chambers is at its maximum for the engine's whole thermodynamic cycle, rapid condensing begins in it, so that the vaporized medium begins to change to liquid.

Exhaust chamber 54 has shrunk to its smallest size, the condensed medium continuing to discharge through exhaust channel and valve 47.

The driving power of an engine according to the invention can also be the pressure forces of various liquids and gases, such as the energy of rapids, rivers, lakes, and the tides of sea.

The variable form of the device and the efficient exploitation of the pressure and mass of the medium in its working and exhaust chambers, make a lever-mechanism machine particularly suitable for above energy sources.

A machine according to the invention is also suitable as a pump, as repeatedly stated previously.

In such a case, the operation takes place by applying an external rotational force to shaft 11, when the moving pistons create expanding and contracting chambers, creating the pump's suction and, correspondingly, expulsion strokes.

It is probable, that the suction and outlet ports can and should be expanded in pump operation, and that possibly it will be necessary to increase the valves to correspond to the requirements, but, however, the principle is the same as in engine operation, only the cycle is inverted.

The operating power of an engine according to the invention can be selected from the most suitable and cheapest alternatives currently available, thus energy in a low-temperature form can be exploited more efficiently than in conventional solutions.

The heater possibly used in an engine solution according to the invention is quite small, because the effective surface area of the pistons of the engine is large in relation to the volume of the cylinder and the work stroke continues at a high torque for more than half of every revolution of shaft 11. This means that the amount of medium required is small in relation to the engine's power, so that the engine is powerful for its size and can be applied to a wide range of purposes.

In addition, a solution according to the invention can be used to exploit relatively low temperature energy and utilize diverse energy sources with the same apparatus. The engine's efficiency reduces the total energy consumption for each application, thus reducing the pollution load.

An engine according to the invention particularly allows the exploitation of the cleanest, renewable energy sources.

The lower energy consumption from the efficiency of the engine and the ease of energy-source selection due to its multi-purpose nature, make it economically possible to switch to cleaner energy sources.

An apparatus according to the invention permits the exploitation of high-temperature energy sources, allowing the exploitation of the energy of exhaust gases and cooling that would otherwise be wasted.

An engine according to the invention requires no external cooling, but acts as its own cooler/condenser.

In part, this creates the high efficiency of the apparatus and the engine's small pollution load.

The solution according to the invention can even be used to reduce the pollution from the exhaust gases of another engine or device.

An engine solution according to the invention can also be connected in series, the medium/gases from the previous engine unit, circulating in channel 17 or released through outlet channels 9, being exploited as the medium/intake gases in the next engine unit, thus extracting the energy content very fully.

Because the apparatuses are clearly easy to build and simple, small, and light, such a combination of many engines will be heavy in any sense.

Particular applications include the exploitation of the exhaust gases or other heat from a combustion engine, through channels 17 and the use of two or more entirely separated and closed heating/cooling/condensing circuits, utilizing a lever-mechanism engine unit according to the invention, or a combined larger totality.

Various adaptations and possible addition parts for each purpose of an engine/pump/condenser/cooler according to the invention will be self-evident to one versed in the art, from the above disclosure.

It is thus obvious, that the invention can be applied in ways other than those particularly depicted, while remaining within the scope of the protection of the accompanying Claims.

The invention claimed is:

1. A lever-mechanism machine, comprising a cylinder, a rotary piston equipped with an eccentrically set shaft set in bearing in a cylinder block, an operating-medium inlet port, an outlet port, and a lever piston, which is mounted in bearings on a lever shaft and which is in essentially tight contact with the rotary piston, so that the cylinder forms an essentially cylindrical first chamber for the rotary piston and a partially cylindrical second chamber for the lever piston that moves backwards and forwards, wherein the lever piston is mounted in bearings at one end of the shaft which is essentially parallel to the eccentrically set shaft and that the lever piston is in essentially tight contact with the surface of the rotary piston, and wherein the lever piston and inlet port are oriented so that an operating medium passing through the inlet port urges the lever piston against the rotary piston whereby the lever piston pushes the rotary piston simultaneously with the operating medium, and wherein the lever piston has a cutaway receiving bore having a profile for receiving the rotary piston, the rotary piston being displaceable by way of the eccentrically set shaft between a starting work stroke position in which the rotary piston is substantially accommodated in the first chamber, in which the outlet port is open, and an ending work and exhaust stroke position in which the rotary piston is received in the receiving bore of the lever piston to fill such receiving bore and in which position the outlet port is closed.

2. A lever-mechanism machine according to claim 1, characterized in that the rotary piston is cylindrical, with an essentially circular cross-section and sliding-collar bearings on the area inside the working chamber.

3. A lever-mechanism machine according to claim 2, characterized in that the end of the lever piston farthest from the lever shaft has lever bearings and pushes against the rotary piston.

4. A lever-mechanism machine according to claim 3, characterized in that the bearings on the rotary piston and the lever bearing are, when the rotary piston rotates, in essentially tight contact.

5. A lever-mechanism machine according to claim 1, characterized in that the medium inlet channel or valve is located in the wall of the chamber for the lever piston and the outlet channel is located on the opposite side of the lever piston.

6. A lever-mechanism machine according to claim 1, characterized in that, in the chamber for the rotary piston, there is a variable-volume working chamber and that, in the chamber for lever piston, there is a variable-volume working chamber on the side with the medium's inlet port.

7. A lever-mechanism machine according to claim 1, characterized in that the machine also has a device to bring thermal energy to the cylinder and transmitting it to the working chambers.

8. A lever-mechanism machine according to claim 7, characterized in that the device has a channel to circulate a heating medium.

9. A lever-mechanism machine according to claim 1, characterized in that the machine comprises at least two machine units, in different work stages relative to each other.

10. A lever-mechanism machine according to claim 9, characterized in that in series-connected machine units, the outlet channel of one unit is connected to the inlet channel of the next unit and/or the outlet channel of the channel is connected to the inlet channel of the next unit, when the outlet channel of the last unit in the series is connected back to the inlet channel of the first unit.

11. A lever-mechanism machine according to claim 1, characterized in that the machine comprises at least three sequential machine units, at different work stages, so that the the operating medium of the machine units in the sequential units in order one after the other and the units are connected to the same shaft.

12. A lever-mechanism machine according to claim 1, characterized in that there is a bore in the lever piston essentially corresponding to the dimensions of the rotary piston, so that the rotary piston enters the bore during each revolution, when the rotary piston and the lever piston are closest to each other.

13. A lever-mechanism machine according to claim 1, characterized in that the pressure surface area of the lever piston is larger than the pressure surface area of the rotary piston.

14. A lever-mechanism machine according to claim 1, characterized in that the operating-medium inlet port and its outlet port are located on different sides of a dividing wall with a moving position, formed by the lever piston and the rotary piston.

15. A machine for use as an engine or pump, which includes a cylinder block, the cylinder block containing a cylinder substantially made up of two linked chambers making up a partially cylindrical lever chamber overlapped by an essentially cylindrical piston chamber, there being two circular portions, the lever chamber having a larger radius than the piston chamber, and a flat step portion on one side between the two radii; the piston chamber having a concentric piston shaft mounted on bearings in the cylinder block and carrying an eccentrically mounted circular piston, the outer surface of the circular piston sealing against the inner cylindrical surface of the piston cylinder as the piston rotates with the piston shaft; the lever chamber having a lever shaft mounted therein parallel to the piston shaft in the step portion at one end thereof remote from the piston chamber, the lever shaft carrying a lever device thereon which moves backwards and forwards in the lever chamber, the end of the lever device opposite the lever shaft, or a point near to the end, maintaining an essentially tight contact with and moving the piston; the lever device having one surface extending from the vicinity of the lever shaft to the vicinity of the piston being matched to the cylindrical inner surface of the lever chamber, and another surface extending from the vicinity of the lever shaft to the vicinity of the piston having a section matched to the outer surface circular of the piston and an essentially straight section matched to the step portion; an operating medium inlet port or valve feeding into the inner circular surface of the lever chamber, and on outlet port or valve feeding from the step portion.

* * * * *